US009831608B1

(12) United States Patent
Pickel et al.

(10) Patent No.: US 9,831,608 B1
(45) Date of Patent: Nov. 28, 2017

(54) ELECTRICAL CONNECTOR HAVING GROUND SHIELD THAT CONTROLS IMPEDANCE AT MATING INTERFACE

(71) Applicant: TYCO ELECTRONICS CORPORATION, Berwyn, PA (US)

(72) Inventors: Justin Dennis Pickel, Hummelstown, PA (US); David Patrick Orris, Middletown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/338,848

(22) Filed: Oct. 31, 2016

(51) Int. Cl.
*H01R 13/64* (2006.01)
*H01R 13/6471* (2011.01)
*H01R 13/6473* (2011.01)
*H01R 13/6586* (2011.01)

(52) U.S. Cl.
CPC ..... *H01R 13/6471* (2013.01); *H01R 13/6473* (2013.01); *H01R 13/6586* (2013.01)

(58) Field of Classification Search
CPC ..... H01R 23/688
See application file for complete search history.

(56) References Cited

U.S. PATENT DOCUMENTS 6,231,391 B1 * 5/2001 Ramey ..... H01R 12/585 439/607.07
6,347,962 B1 * 2/2002 Kline ..... H01R 13/6587 439/181
6,379,188 B1 * 4/2002 Cohen ..... H01R 13/514 439/101
6,461,202 B2 * 10/2002 Kline ..... H01R 23/688 439/607.05
6,471,549 B1 * 10/2002 Lappohn ..... H01R 23/688 439/101
6,638,079 B1 * 10/2003 Billman ..... H01R 13/514 439/76.1
6,764,341 B2 * 7/2004 Lappoehn ..... H01R 13/6585 439/607.05
6,808,420 B2 * 10/2004 Whiteman, Jr. ... H01R 13/6587 439/108
6,808,421 B2 * 10/2004 Okada ..... H01R 13/405 439/607.06
6,827,611 B1 * 12/2004 Payne ..... H01R 23/688 439/607.05
6,899,566 B2 * 5/2005 Kline ..... H01R 13/514 439/108
6,913,490 B2 * 7/2005 Whiteman, Jr. ... H01R 13/6587 439/108

(Continued)

*Primary Examiner* — Ross Gushi

(57) ABSTRACT

An electrical connector includes a housing, a signal contact, and a ground shield. The housing includes a base having a front side and an opposite rear side. The signal contact is received in the base and has a mating segment that extends forward of the front side. The ground shield is received in the base and extends forward of the front side. The ground shield surrounds the signal contact on at least one side thereof. The ground shield includes a deflectable spring tab extending from an inner surface of the ground shield towards the signal contact without engaging the signal contact. The spring tab is positioned forward of the front side of the base. The spring tab is configured to be deflected outward by a mating connector in a direction away from the signal contact during a mating operation.

20 Claims, 8 Drawing Sheets

(56) References Cited

U.S. PATENT DOCUMENTS 7,094,102 B2 * 8/2006 Cohen ..... H05K 1/14 439/607.08
7,267,515 B2 * 9/2007 Lappohn ..... H01R 13/514 439/607.07
7,278,886 B2 * 10/2007 Cohen ..... H05K 1/14 439/607.08
7,530,846 B1 * 5/2009 Chen ..... H01R 23/688 439/607.05
7,604,502 B2 * 10/2009 Pan ..... H01R 23/688 439/607.08
7,785,148 B2 * 8/2010 Pan ..... H01R 13/514 439/607.06
7,811,130 B2 * 10/2010 Cohen ..... H05K 1/14 439/607.1
7,955,130 B2 * 6/2011 Liu ..... H01R 23/688 439/607.09
7,976,340 B1 * 7/2011 Saraswat ..... H01R 13/6587 439/108
8,167,651 B2 * 5/2012 Glover ..... H01R 12/585 439/607.08
8,202,118 B2 * 6/2012 Cohen ..... H05K 1/14 439/607.1
8,382,522 B2 * 2/2013 Glover ..... H01R 12/585 439/607.08
8,398,432 B1 * 3/2013 McClellan ..... H01R 13/6587 439/607.07
8,398,434 B2 * 3/2013 Davis ..... H01R 12/724 439/607.34
8,419,472 B1 * 4/2013 Swanger ..... H01R 13/6587 439/607.07
8,430,691 B2 * 4/2013 Davis ..... H01R 13/6585 439/607.09
8,444,435 B2 * 5/2013 Lee ..... H01R 13/6587 439/607.07
8,517,765 B2 * 8/2013 Schroll ..... H01R 13/6586 439/108
8,535,065 B2 * 9/2013 Costello ..... H01R 13/6585 439/607.03
8,591,260 B2 * 11/2013 Davis ..... H01R 13/6586 439/607.55
8,641,448 B2 * 2/2014 Lappoehn ..... H01R 23/688 439/607.09
8,662,924 B2 * 3/2014 Davis ..... H01R 13/6477 439/607.07
8,715,005 B2 * 5/2014 Pan ..... H01R 13/6586 439/607.1
8,715,006 B2 * 5/2014 Jeon ..... H01R 12/585 439/607.1
8,777,663 B2 * 7/2014 Annis ..... H01R 13/514 439/607.05
8,870,594 B2 * 10/2014 McClellan ..... H01R 13/6587 439/607.05
8,905,786 B2 * 12/2014 Davis ..... H01R 13/6587 439/108
8,961,229 B2 * 2/2015 Pan ..... H01R 13/6474 439/607.07
8,992,252 B2 * 3/2015 McClellan ..... H01R 13/6581 439/108
9,093,800 B2 * 7/2015 Laub ..... H01R 12/727
9,142,896 B2 * 9/2015 Wickes ..... H01R 9/2408
9,225,122 B1 * 12/2015 Evans ..... H01R 13/6588
9,373,917 B2 * 6/2016 Sypolt ..... H01R 13/6585
9,425,556 B1 * 8/2016 Pickel ..... H01R 13/6582
9,548,570 B2 * 1/2017 Laurx ..... H01R 13/41
9,570,857 B2 * 2/2017 Morgan ..... H01R 13/6471
2003/0003803 A1 * 1/2003 Billman ..... H01R 13/514 439/607.05
2003/0022555 A1 * 1/2003 Vicich ..... H01R 23/688 439/607.05
2010/0093209 A1 * 4/2010 Liu ..... H01R 13/6587 439/541.5
2011/0143591 A1 * 6/2011 Davis ..... H01R 13/6587 439/607.27
2011/0263141 A1 * 10/2011 Ko ..... H01R 12/707 439/83
2013/0017723 A1 * 1/2013 Davis ..... H01R 13/6596 439/607.28
2014/0080331 A1 * 3/2014 Jeon ..... H01R 13/65807 439/84
2014/0194004 A1 * 7/2014 Pickel ..... H01R 13/648 439/607.01
2015/0011125 A1 * 1/2015 Jeon ..... H01R 13/646 439/620.15
2016/0233618 A1 * 8/2016 Laurx ..... H01R 13/6587
2016/0344141 A1 * 11/2016 Cartier, Jr. ..... H01R 13/6585
2017/0005445 A1 * 1/2017 Resendez ..... H01R 9/034

* cited by examiner

ELECTRICAL CONNECTOR HAVING GROUND SHIELD THAT CONTROLS IMPEDANCE AT MATING INTERFACE

BACKGROUND OF THE INVENTION

The subject matter herein relates generally to an electrical connector having signal contacts and associated ground shields.

Some electrical connector systems utilize receptacle and header connectors to interconnect two circuit boards, such as a motherboard and daughtercard. When the connectors are mated, the circuit boards may be arranged parallel to one another. Such connector systems can be complex and difficult to manufacture.

The connectors can have ground shields that are designed to shield signal contacts from other signal contacts within the connectors. During a mating operation, the ground shields of the header connector engage the ground shields of the receptacle connector and the signal contacts of the header connector engage the signal contacts of the receptacle connector. The connectors may be fully mated relative to one another when respective housings of the two connectors engage one another to prohibit further movement in the mating direction. The connectors are partially mated to one another when the ground shields and signal contacts of the two connectors are engaged but the housings do not engage one another. The connectors may be partially mated to one another when, due to various aggregated tolerances in the electrical system or device, the two circuit boards are too far apart from each other to allow the two connectors to fully mate to one another. For example, the two circuit boards may be fixed in place on different mounts of a chassis, such that the distance between the two circuit boards may not be precisely controlled due to tolerances between various components in the system.

Although partial mating of the connectors does provide an electrically conductive signal path between the circuit boards, the signal quality and/or strength may be degraded relative to two connectors that are fully mated. For example, when the connectors are partially mated, an air gap may exist along the mating interface between the front ends of the respective housings of the connectors. The air gap may cause an impedance spike along the signal contacts that causes some of the energy to reflect back to the source instead of being transmitted between the connectors. The impedance spike may have a greater detrimental effect with higher signal transmission speeds, such as speeds over 10 Gb/s.

A need remains for an electrical connector having enhanced ground shielding that improves electrical performance by controlling the impedance at the mating interface.

BRIEF DESCRIPTION OF THE INVENTION

In one embodiment, an electrical connector is provided that includes a housing, a signal contact, and a ground shield. The housing includes a base having a front side and an opposite rear side. The signal contact is received in the base. The signal contact has a mating segment extending forward of the front side of the base. The ground shield is received in the base and extends forward of the front side of the base. The ground shield surrounds the signal contact on at least one side along a length of the signal contact. The ground shield includes an inner surface that faces the signal contact and an opposite outer surface. The ground shield includes a deflectable spring tab extending from the inner surface towards the signal contact without engaging the signal contact. The spring tab is positioned forward of the front side of the base. The spring tab is configured to be deflected outward by a mating housing of a mating connector in a direction away from the signal contact during a mating operation.

In another embodiment, an electrical connector is provided that includes a housing, a signal contact, and a ground shield. The housing includes a base having a front side and an opposite rear side. The signal contact is received in the base. The signal contact has a mating segment extending forward of the front side of the base. The mating segment of the signal contact is configured to be received in a signal opening of a mating housing of a mating connector during a mating operation. The ground shield is received in the base and extends forward of the front side of the base. The ground shield surrounds the signal contact on at least one side along a length of the signal contact. The ground shield includes an inner surface that faces the signal contact and an opposite outer surface. The ground shield includes a deflectable spring tab extending from the inner surface. The spring tab in an undeflected position extends towards the signal contact without engaging the signal contact. The spring tab is positioned forward of the front side of the base. The ground shield is configured to be received in a ground slot of the mating housing during the mating operation. The spring tab is variably positionable based on a mating depth that the ground shield extends into the ground slot of the mating housing during the mating operation.

DETAILED DESCRIPTION OF THE INVENTION

Figure 1:
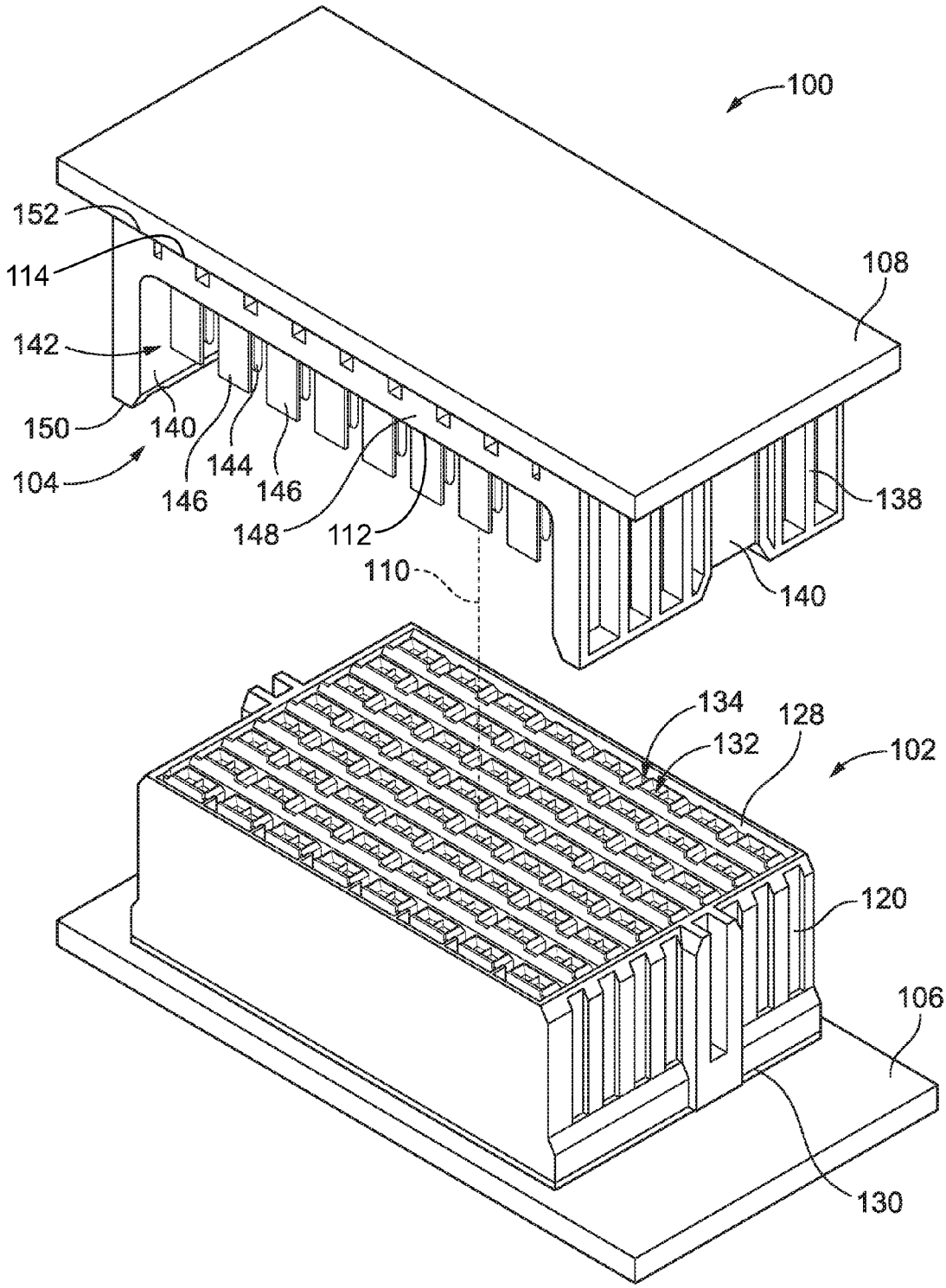
FIG. 1 is a perspective view of a connector assembly illustrating a receptacle connector and a header connector poised for mating according to an embodiment.

FIG. 1 is a perspective view of a connector assembly 100 illustrating a receptacle connector 102 and a header connector 104 poised for mating according to an embodiment. The receptacle and header connectors 102, 104 may be directly mated together along a mating axis 110 to provide a conductive signal transmission path across the connectors 102, 104. In an embodiment, the receptacle connector 102 and the header connector 104 are provided in a mezzanine arrangement between circuit boards. For example, the receptacle connector 102 is mounted to and electrically connected to a first circuit board 106, and the header connector 104 is mounted to and electrically connected to a second circuit board 108. The receptacle and header connectors 102, 104 are utilized to electrically connect the circuit boards 106, 108 to one another at a separable mating interface.

In an exemplary embodiment, the circuit boards 106, 108 are oriented parallel to one another and spaced apart from one another with the connectors 102, 104 therebetween. The circuit boards 106, 108 and connectors 102, 104 define a mezzanine arrangement where the circuit boards 106, 108 and connectors 102, 104 are stacked. The circuit boards 106, 108 may be oriented horizontally, with the connectors 102, 104 defining vertical connectors between the horizontal circuit boards 106, 108. The connectors 102, 104 are in-line connectors such that the signal contacts extend generally linearly between the circuit boards 106, 108. Other orientations of the circuit boards 106, 108 are possible in alternative embodiments. For example, one or both of the connectors 102, 104 may be a right angle connector instead of an in-line connector. In another embodiment, one or both of the connectors 102, 104 may be cable-mounted to an electrical cable instead of mounted to a circuit board.

Figure 5:
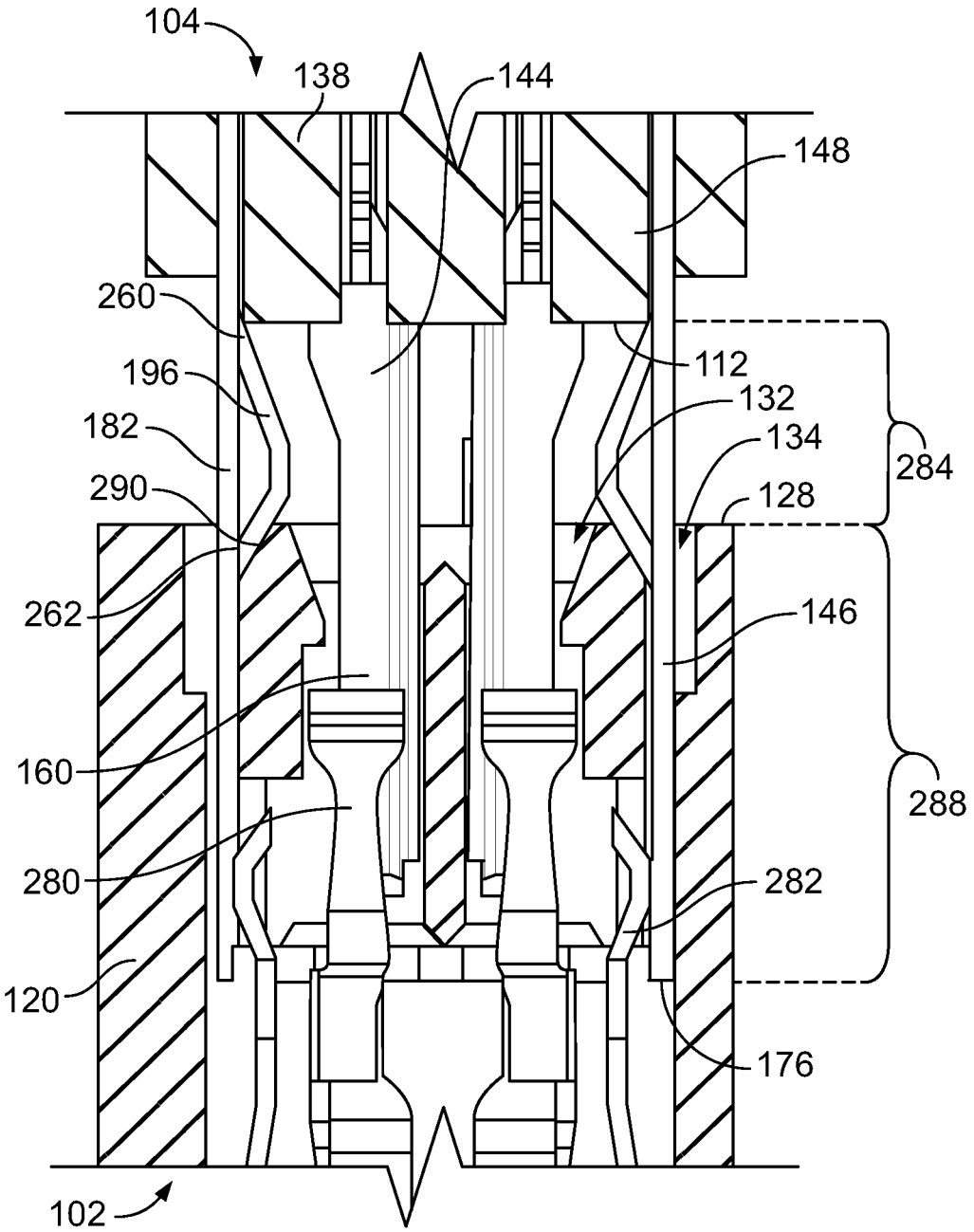
FIG. 5 is cross-sectional view of a portion of the header connector in a first partially mated position relative to a corresponding portion of the receptacle connector according to an embodiment.

The receptacle connector 102 includes a receptacle housing 120 that holds a plurality of receptacle signal contacts 280 (shown in FIG. 5). The receptacle signal contacts 280 are electrically shielded by receptacle ground contacts 282 (shown in FIG. 5). The receptacle housing 120 extends between a mating end 128 and a mounting end 130. In the illustrated embodiment, the mounting end 130 is oriented substantially parallel to the mating end 128. The receptacle housing 120 includes a plurality of signal openings 132 and a plurality of ground slots 134 at the mating end 128. The signal openings 132 and ground slots 134 may extend fully through the receptacle housing 120 between the mating and mounting ends 128, 130. The receptacle signal contacts 280 are disposed in the corresponding signal openings 132, and the receptacle ground contacts 282 are disposed in the ground slots 134. The signal openings 132 receive corresponding header signal contacts 144 therein when the receptacle and header connectors 102, 104 are mated to allow the header signal contacts 144 to mate with the receptacle signal contacts 280. The ground slots 134 receive header ground shields 146 therein when the receptacle and header connectors 102, 104 are mated to allow the header ground shields 146 to mate with the receptacle ground contacts 282.

The receptacle housing 120 may be manufactured from a dielectric material, such as a plastic material, that provides electrical insulation between the signal contact openings 132 and the ground slots 134. Therefore, the receptacle housing 120 may electrically insulate the receptacle signal contacts 280 (shown in FIG. 5) and the header signal contacts 144 in the signal openings 132 from the receptacle ground contacts 282 (shown in FIG. 5) and the header ground shields 146 in the ground slots 134. The receptacle housing 120 also controls electrical characteristics such as impedance along the portion of the signal transmission path extending through the receptacle housing 120 as the dielectric material surrounds the signal contacts 280, 144 within the signal openings 132. Although not shown, the receptacle signal contacts 280 and the receptacle ground contacts 282 may protrude beyond the mounting end 130 of the receptacle housing 120 for electrically terminating (for example, electrically connecting in direct mechanical engagement) to the first circuit board 106.

The header connector 104 includes a header housing 138 extending between a mating end 150 and an opposite mounting end 152 that is mounted to the second circuit board 108. The header housing 138 includes a base wall or housing base 148, referred to herein as a base 148, that has a front side 112 and an opposite rear side 114. As used herein, relative or spatial terms such as "front," "rear," "top," "bottom," "first," and "second," are only used to distinguish the referenced elements and do not necessarily require particular positions or orientations relative to the surrounding environment of the header connector 104 or the connector assembly 100. The rear side 114 faces the circuit board 108 and may define the mounting end 152 of the header housing 138. The header signal contacts 144 and the header ground shields 146 are received in the base 148 and held in place by the base 148. The signal contacts 144 and the ground shields 146 extend from the front side 112 of the base 148 to be received in the respective signal openings 132 and ground slots 134 of the receptacle housing 120 when the connectors 102, 104 are mated. Although not shown in FIG. 1, the header signal contacts 144 and the header ground shields 146 protrude from the rear side 114 of the base 148 and terminate to the circuit board 108.

In the illustrated embodiment, the header housing 138 includes shroud walls 140 that extend from the base 148 to the mating end 150 of the housing 138. The shroud walls 140 and the front side 112 of the base 148 define a cavity 142 that is open at the mating end 150. For example, the shroud walls 140 define sides of the cavity 142 and the base 148 defines an end or bottom of the cavity 142. The header signal contacts 144 and ground shields 146 extend from the base 148 into the cavity 142. The receptacle connector 102 is received in the cavity 142 through the mating end 150 during a mating operation. The receptacle housing 120 may engage the shroud walls 140 to guide the receptacle connector 102 into the cavity 142 to mate with the header connector 104.

In one or more embodiments described herein, the header connector 104 is configured to control the impedance at the mating interface between the header connector 104 and the receptacle connector 102 based on an extent that the header connector 104 is mated to the receptacle connector 102. For example, the header connector 104 may accommodate scenarios in which the header connector 104 is fully mated to the receptacle connector 102 and scenarios in which, due to various tolerances in the system, the header connector 104 only partially mates to the receptacle connector 102. When fully mated, the receptacle housing 120 and the header housing 138 reach a hard stop position that prevents further movement in a mating direction. When partially mated, the signal contacts 144 and the ground shield 146 of the header connector 104 engage and electrically connect to the corresponding signal contacts 280 and ground contacts 282 of the receptacle connector 102, but the receptacle housing 120 and the header housing 138 do not reach the hard stop position. The connectors 102, 104 may be prevented from reaching the fully mated position when the circuit boards 106, 108 are fixed in place and separated from each other by a distance that is slightly greater than the combined length of the fully mated connectors 102, 104 from the mounting end 130 of the receptacle housing 120 to the mounting end 152 of the header housing 138. In this scenario, the connectors 102, 104 may be partially mated such that electrical signal paths are established between the circuit boards 106, 108, but the connectors 102, 104 are unable to be moved further in the mating direction. In the partially mated position, an air gap is defined at the mating interface between the mating end 128 of the receptacle housing 120 and the front side 112 of the base 148 of the header housing 138. The header signal contacts 144 and ground shields 146 extend across the air gap and are received in the corresponding signal openings 132 and ground slots 134 of the receptacle housing 120. The air gap may cause an impedance spike along the signal path, especially at higher transmission speeds of at least 10 Gb/s or at least 20 Gb/s, which causes signal degradation.

In one or more embodiments described herein, the header ground shields 146 include deflectable spring tabs (for example, the spring tabs 196 shown in FIG. 2) that are configured to reduce and/or smooth the impedance spike caused by partial mating of the connectors 102, 104. For example, the spring tabs are located at the mating interface between the connectors 102, 104 and align with the air gap formed due to partial mating. The spring tabs are configured to be variably positionable relative to the signal contacts 144 based on the extent (or depth) of mating between the connectors 102, 104. For example, if the connectors 102, 104 are fully mated, the spring tabs are disposed farther from the signal contacts 144 than if the connectors 102, 104 are only partially mated. In a fully mated scenario, the air gap is non-existent or negligible and the receptacle housing 120 provides sufficient impedance control. Therefore, the spring tabs are not necessary and are moved away from the signal contacts 144. In a partially mated scenario, however, the spring tabs extend closer to the signal contacts 144. The spring tabs are configured to counteract the impedance spike due to the air gap by providing conductive material that is more proximate to the signal contacts 144 than other portions of the ground shield 146. The spring tabs therefore improve signal transmission across the connectors 102, 104 by reducing the impedance spike that results from partial mating of the connectors 102, 104, and the spring tabs do not interfere with signal transmission when the connectors 102, 104 are fully mated.

Figure 2:
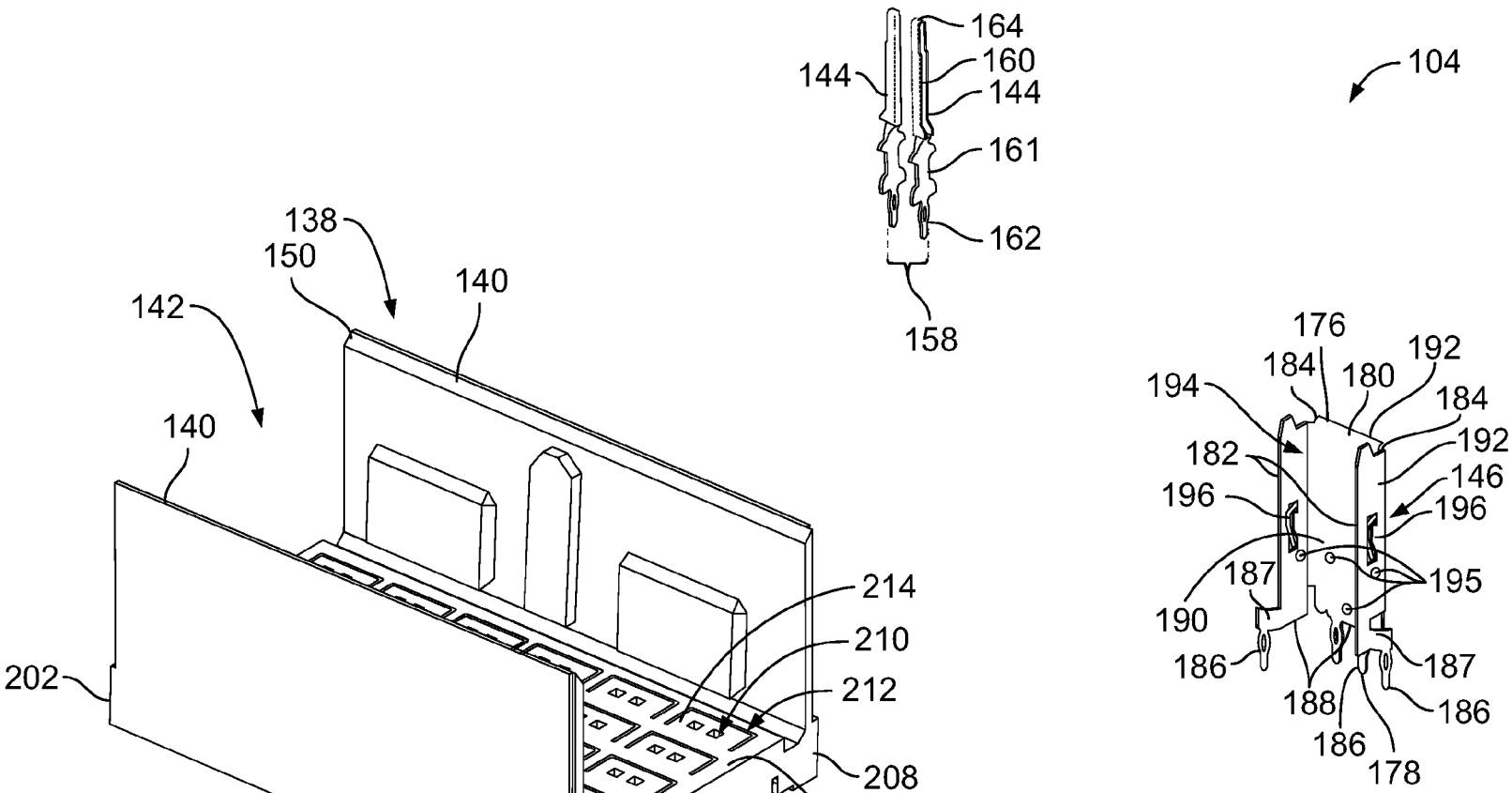
FIG. 2 is an exploded perspective view of the header connector according to an embodiment.

FIG. 2 is an exploded perspective view of the header connector 104 according to an embodiment. The header connector 104 includes the header housing 138, multiple header signal contacts 144, and multiple header ground shields 146. As used herein, the header connector 104, the header housing 138, the header signal contacts 144, and the header ground shields 146 may be referred to simply as connector 104, housing 138, signal contacts 144, and ground shields 146, respectively. The receptacle connector 102 (shown in FIG. 1) and components thereof (for example, the receptacle housing 120) may be referred to as mating connector 102 and mating components (for example, mating housing 120). The illustrated pair 158 of signal contacts 144 and the ground shield 146 may be representative of other signal contacts 144 and ground shields 146 of the connector 104 that are not shown in FIG. 2.

The pair 158 of signal contacts 144 may be used to convey differential signals. The signal contacts 144 may extend generally parallel to each other. The signal contacts 144 are composed of one or more conductive metal materials, such as copper, silver, gold, or the like. The signal contacts 144 may be stamped and formed or molded. The signal contacts 144 have a mating segment 160, a contact tail 162, and an intermediate segment 161 between the mating segment 160 and the tail 162. The mating segment 160 extends to a distal end 164 of the signal contact 144 and is configured to engage a corresponding receptacle signal contact 280 (shown in FIG. 5) of the receptacle connector 102 (shown in FIG. 1) when the connectors 102, 104 are mated. The mating segment 160 in the illustrated embodiment is a pin or blade, but may have another shape and/or interface in an alternative embodiment, such as a socket. The contact tails 162 of the signal contacts 144 are configured to terminate to the circuit board 108 (shown in FIG. 1) to electrically connect the signal contacts 144 to the circuit board 108. In the illustrated embodiment, the contact tails 162 are compliant pins, such as eye-of-the-needle pins, that are configured to be through-hole mounted to the circuit board 108. For example, the contact tails 162 may be received in corresponding electrical vias or through-holes (not shown) defined in the circuit board 108. In another embodiment, the contact tails 162 may be solder tails configured to be surface-mounted to the circuit board 108, or the like.

The ground shield 146 extends between a mating end 176 and a terminating end 178. In the illustrated embodiment, the ground shield 146 has a center wall 180 and two side walls 182 that extend from respective edges 184 of the center wall 180. The center wall 180 and the side walls 182 are generally planar. The side walls 182 may extend generally parallel to each other in a common direction from the center wall 180. Thus, the ground shield 146 has a C-shaped cross-section defined by a plane that intersects the center wall 180 and the two side walls 182 at a perpendicular angle relative to the center and side walls 180, 182. The side walls 182 may be oriented at approximately right angles relative to a plane of the center wall 180. Alternatively, the center wall 180 and/or the side walls 182 may be at least partially curved. The ground shield 146 may be stamped and formed from a sheet of metal. For example, the center wall 180 may be formed integral to the side walls 182, such that the side walls 182 are bent out of plane from the center wall 180. Although the ground shield 146 has three walls 180, 182 and forms a C-shaped (or U-shaped) cross-section in the illustrated embodiment, the ground shields 146 may have other shapes in alternative embodiments. For example, the ground shield 146 may alternatively have an L-shaped cross-section defined by the center wall 180 and one side wall 182, may have a thin rectangular cross-section defined by the center wall 180 (or one of the side walls 182) only, may have a rectangular or box-shaped cross-section defined by two center walls 180 and two side walls 182, or may include more than four walls.

The ground shield 146 includes contact tails 186 extending from rear edges 188 of the center wall 180 and side walls 182 to the terminating end 178. The contact tails 186 in the illustrated embodiment are compliant pins configured to be through-hole mounted to the circuit board 108 (shown in FIG. 1) to provide an electrical grounding path between the ground shield 146 and the circuit board 108. Optionally, the ground shield 146 includes a tab 187 extending from each of the side walls 182 proximate to the rear edges 188. One contact tail 186 extends from each of the tabs 187. The tabs 187 may be used to match the footprint of the ground shield 146 to a designated arrangement of vias or through-holes in the circuit board 108. In an alternative embodiment, instead of compliant pins, the contact tails 186 may be solder tails configured to be surface-mounted to the circuit board 108 or another type of mounting interface. In the illustrated embodiment, the center wall 180 and the side walls 182 extend from the respective rear edges 188 to the mating end 176 of the ground shield 146. In an alternative embodiment, the mating end 176 may be defined by the center wall 180 or the side walls 182, but not both.

The center wall 180 and the side walls 182 of the ground shield 146 have inner surfaces 190 and opposite outer surfaces 192. The inner surfaces 190 of the walls 180, 182 define a channel 194 configured to receive a corresponding pair 158 of signal contacts 144 therein. The inner surfaces 190 generally face towards the signal contacts 144. The outer surfaces 192 face away from the signal contacts 144 in the channel 194.

Optionally, the ground shield 146 includes multiple interference protrusions 195 along the center wall 180 and/or the side walls 182 to increase the friction fit of the ground shield 146 within the base 148 of the housing 138, as described below. The interference protrusions 195 may be bumps, bulges, or the like that extend from the plane of the respective walls 180, 182. Some interference protrusions 195 may be disposed along the inner surfaces 190, and other protrusions 195 may be disposed along the outer surfaces 192. The interference protrusions 195 may be disposed at different positions along the ground shield 146 between the mating and terminating ends 176, 178. In an embodiment, the protrusions 195 are clustered in a region of the ground shield 146 that is more proximate to the rear edges 188 of the walls 180, 182 than to the mating end 176 to allow the protrusions 195 to align with and engage the base 148 of the housing 138.

The ground shield 146 further includes deflectable spring tabs 196. The spring tabs 196 protrude from the side walls 182 into the channel 194. The spring tabs 196 are configured to be deflected outward away from the channel 194 during the mating operation. The spring tabs 196 are located between the mating and terminating ends 176, 178. For example, the spring tabs 196 may be disposed between the mating end 176 and the interference protrusions 195. The spring tabs 196 are spaced apart from the mating end 176. In the illustrated embodiment, the ground shield 146 includes two spring tabs 196 that are located on the two side walls 182, but in other embodiments the ground shield 146 may include more or less than two spring tabs 196 and/or the one or more spring tabs 196 may be located on the center wall 180 instead of, or in addition to, the side walls 182. The spring tabs 196 may be formed out of the side walls 182, such as by stamping and/or punching the spring tabs 196 out of the walls 182. Alternatively, the spring tabs 196 may be discrete components that are attached to the walls 182 via soldering, adhesives, or the like.

The housing 138 is oriented in the illustrated embodiment such that the mating end 150 faces upward. The base 148 extends a length between opposite first and second ends 202, 204 and extends a width between opposite first and second edge sides 206, 208. In the illustrated embodiment, the housing 138 includes two shroud walls 140 that extend from the edge sides 206, 208. The shroud walls 140 define sides of the cavity 142. The cavity 142 is open along the mating end 150 and along the first and second ends 202, 204 of the base 148. In an alternative embodiment, the housing 138 may include additional shroud walls extending along the ends 202, 204 to fully-enclose a perimeter of the cavity 142. In another alternative embodiment, the housing 138 may include only one or no shroud walls 140.

The base 148 of the housing 138 defines signal openings 210 extending through the base 148. The signal openings 210 are sized and shaped to each receive and hold a signal contact 144 therein. In the illustrated embodiment, the signal openings 210 are arranged in pairs to receive the pairs 158 of signal contacts 144. The base 148 also includes ground slots 212 extending through the base 148 that are configured to receive and hold the ground shields 146. The signal openings 210 and the ground slots 212 extend fully through the base 148 between the front and rear sides 112, 114. The signal openings 210 and the ground slots 212 are arranged in an array of multiple columns and rows along the base 148. The housing 138, or at least the base 148 thereof, is composed of a dielectric material, such as one or more plastics, conductive polymers, or the like. The base 148 includes divider walls 214 that define and extend between the signal openings 210 and the ground slots 212. The divider walls 214 electrically insulate the signal contacts 144 from other signal contacts 144 and the ground shields 146. The signal openings 210 and the ground slots 212 are sized and shaped to accommodate the signal contacts 144 and the ground shields 146, respectively, and to hold the signal contacts 144 and the ground shields 146 in fixed positions. Therefore, the ground slots 212 are C-shaped in the illustrated embodiment. When the ground shield 146 is received in a corresponding ground slot 212, the interference protrusions 195 may engage the surfaces of the divider walls 214 that define the ground slot 212 to increase the frictional fit of the ground shield 146 in the slot 212. The intermediate segment 161 of the signal contact 144 is received in the signal opening 210 and engages the surfaces of the divider walls 214 that define the signal opening 210. The signal openings 210 optionally may include crush ribs (not shown) therein to increase the frictional fit of the signal contacts 144 within the signal openings 210.

In an alternative embodiment, instead of the base 148 defining two separate signal openings 210 for each pair 158 of signal contacts 144, the base 148 may define chambers that are larger than the two adjacent signal openings 210. For example, the pairs 158 of signal contacts 144 may be embedded within corresponding dielectric inserts to define signal pods, and each signal pod may be loaded into a corresponding one of the chambers of the base 148 to fix to the signal contacts 144 to the base 148. Optionally, the chambers may be large enough to accommodate a ground shield 146 in addition to a signal pod, and the dielectric insert electrically insulates the signal contacts 144 therein from the ground shield 146. Alternatively, the chambers accommodate only the signal pods, and the chambers are separated from the ground slots 212 by divider walls of the base 148.

Figure 3:
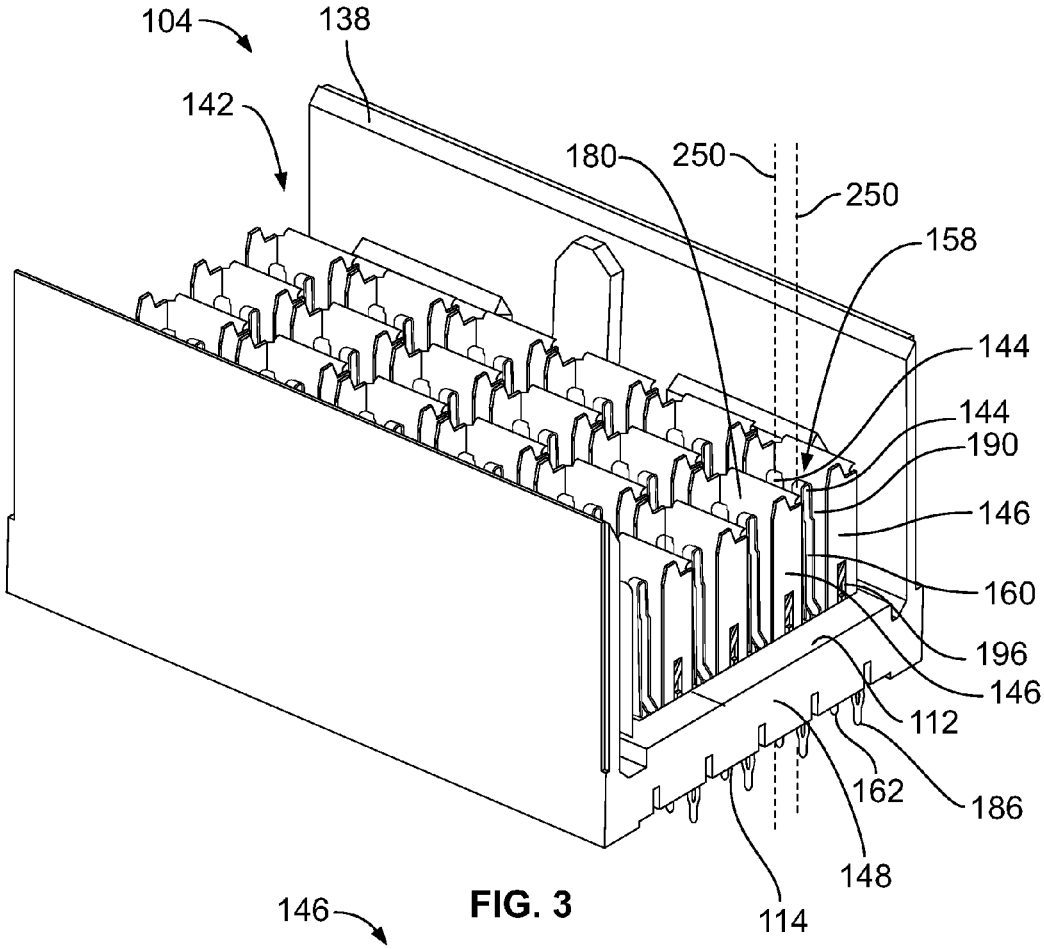
FIG. 3 is an assembled perspective view of the header connector according to an embodiment.

FIG. 3 is an assembled perspective view of the header connector 104 according to an embodiment. The signal contacts 144 and the ground shields 146 are loaded in the respective signal openings 132 and ground slots 134 (both shown in FIG. 2) of the base 148. The mating segments 160 of the signal contacts 144 extend forward from the front side 112 of the base 148 into the cavity 142 to mate with the signal contacts 280 (shown in FIG. 5) of the receptacle connector 102 (shown in FIG. 1). The contact tails 162 of the signal contacts 144 extend from the rear side 114 of the base 148 for terminating to the circuit board 108 (shown in FIG. 1). The signal contacts 144 may extend along contact axes 250. In an embodiment, the front side 112 of the base 148 is parallel to the rear side 114, and the contact axes 250 are perpendicular to the planes defined by the front and rear sides 112, 114. The ground shields 146 surround and electrically shield the signal contacts 144 along at least a length of the signal contacts 144. For example, the ground shields 146 extend from the front side 112 of the base 148 into the cavity 142 to surround and electrically shield the mating segments 160 of the signal contacts 144. In the illustrated embodiment, the ground shields 146 each surround a corresponding pair 158 of signal contacts 144 on three sides of the pair 158. The center wall 180 of an adjacent ground shield 146 in the same column or row provides shielding for the pair 158 along the open, fourth side of the pair 158. The inner surfaces 190 of the ground shields 146 face the signal contacts 144. In other embodiments, each ground shield 146 may surround a corresponding signal contact 144 along one, two, or all four sides along the length of the signal contact 144. The segments of the ground shields 146 in the cavity 142 are configured to mate with the ground contacts 282 (shown in FIG. 5) of the receptacle connector 102. The contact tails 186 of the ground shields 146 extend from the rear side 114 of the base 148 for terminating to the circuit board 108.

In the illustrated embodiment, the deflectable spring tabs 196 of the ground shields 146 are positioned forward of the front side 112 of the base 148. For example, the spring tabs 196 may have one end fixed to the ground shields 146 proximate to the front side 112 of the base 148. The spring tabs 196 extend from that end forward of the front side 112 to an opposite end that is remote from the front side 112. Therefore, a majority, if not an entirety, of the spring tabs 196 are disposed outside of the ground slots 212 (shown in FIG. 2) and forward of the base 148. The spring tabs 196 are disposed at least proximate to the front side 112 such that the spring tabs 196 align with an air gap defined between the front side 112 of the base 148 and the mating end 128 (shown in FIG. 1) of the receptacle housing 120 (FIG. 1) when the header connector 104 and the receptacle connector 102 (FIG. 1) are partially mated.

Figure 4:
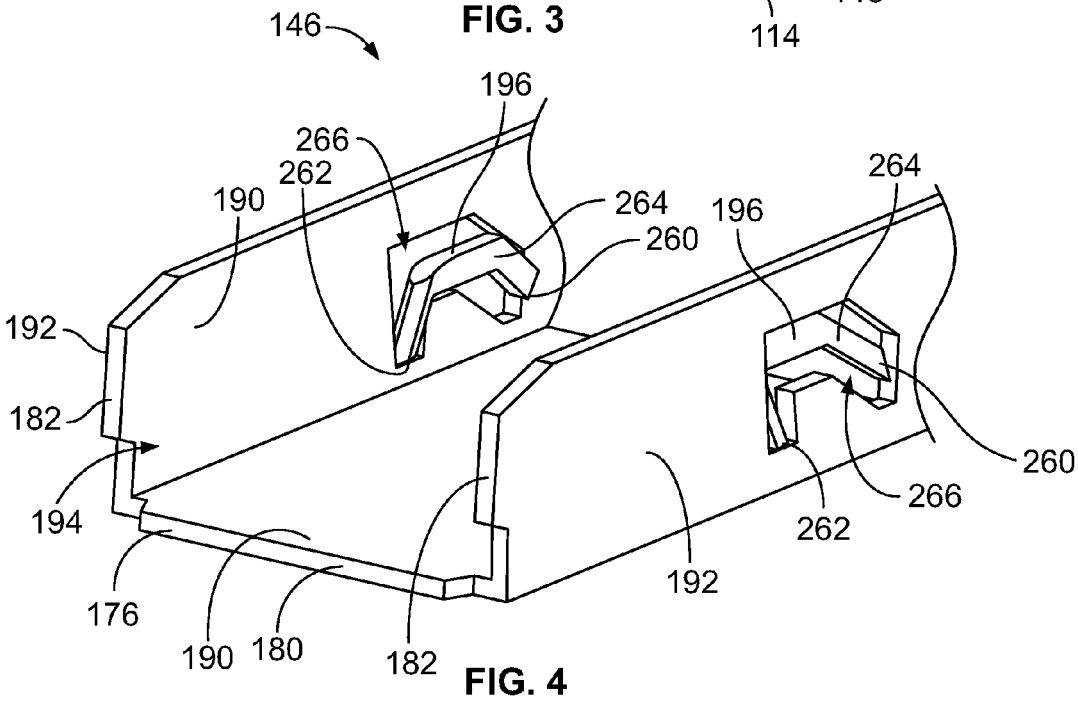
FIG. 4 is a perspective view of a portion of one ground shield of the header connector according to an embodiment.

FIG. 4 is a perspective view of a portion of one of the ground shields 146 of the header connector 104 according to an embodiment. The ground shield 146 in FIG. 4 may be the ground shield 146 shown in FIG. 2. The illustrated portion of the ground shield 146 shown in FIG. 4 extends from the mating end 176 to beyond the deflectable spring tabs 196. The contact tails 186 at the terminating end 178 (both shown in FIG. 2) of the ground shield 146 are not shown in FIG. 4.

In the illustrated embodiment, the ground shield 146 includes two deflectable spring tabs 196. Each of the spring tabs 196 is mounted to and extends from a different one of the two side walls 182. The spring tabs 196 mirror each other and extend towards each other across the channel 194. Although the spring tabs 196 are disposed on the side walls 182, in an alternative embodiment, one or more spring tabs 196 may be disposed on the center wall 180. The following description of one spring tab 196 may be understood to refer to both of the spring tabs 196 of the ground shield 146 shown in FIG. 4. The spring tab 196 extends between a first end 260 and a second end 262. The first and second ends 260, 262 are both secured or anchored to the corresponding side wall 182. For example, in the embodiment in which the spring tab 196 is formed integral to the ground shield 146, the ends 260, 262 may be integrally connected to the side wall 182. In another embodiment, one or both of the ends 260, 262 may be secured to the side wall 182 via soldering or another welding operation, an adhesive, a fastener, or the like. The ends 260, 262 are secured or fixed in place such that the ends 260, 262 are not configured to move relative to the side wall 182, although the spring tab 196 is configured to bend and/or deflect between the ends 260, 262 relative to the side wall 182.

Figure 8:
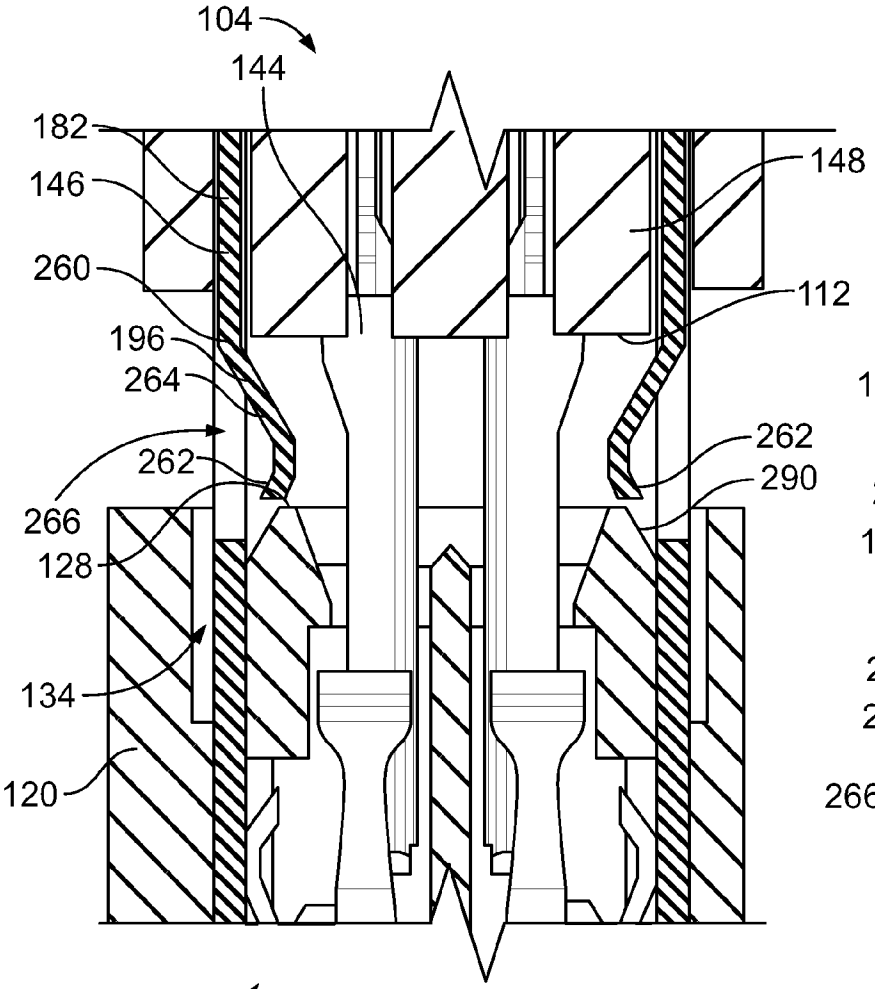
FIG. 8 is a cross-sectional view of a portion of the header connector in a partially mated position relative to the receptacle connector according to an alternative embodiment.
Figure 9:
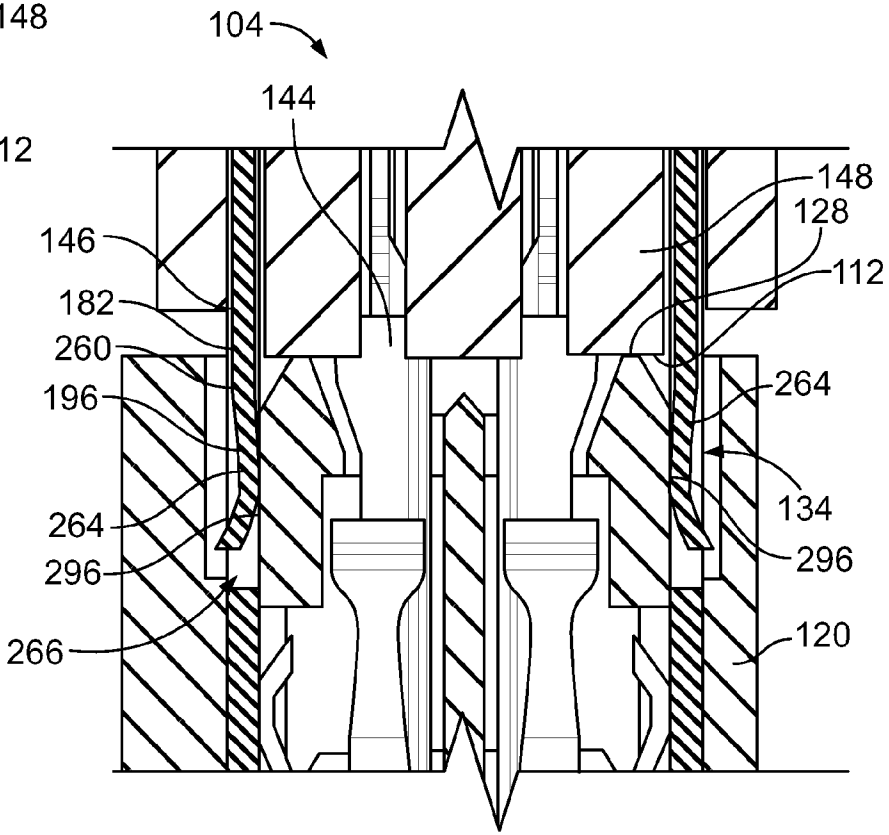
FIG. 9 is a cross-sectional view of the portion of the header connector shown in FIG. 8 in a fully mated position relative to the receptacle connector.
Figure 10:
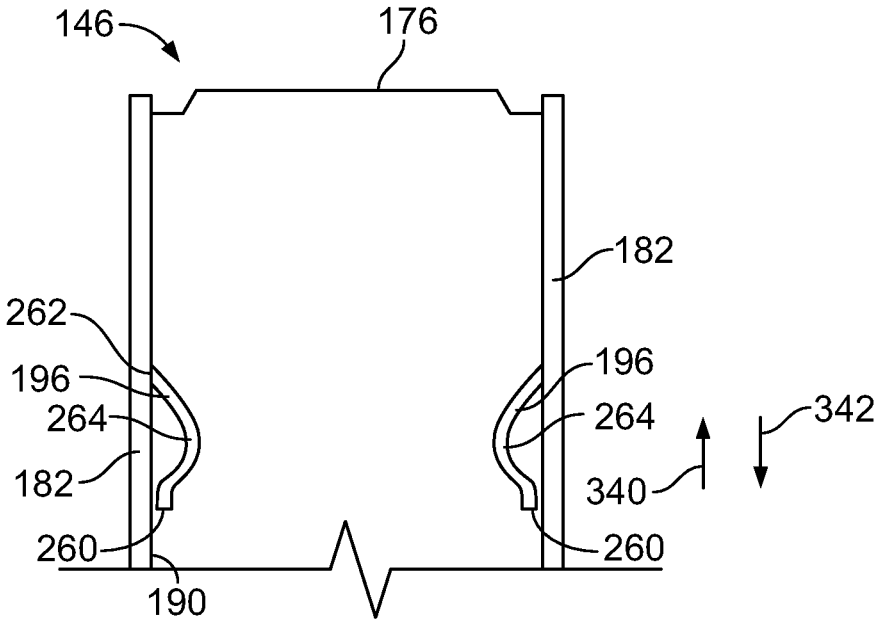
FIG. 10 illustrates a portion of the ground shield according to another alternative embodiment.

The spring tab 196 includes a beam 264 that extends between the ends 260, 262. The beam 264 is curved and protrudes from the side wall 182 into the channel 194 (for example, out of the plane of the side wall 182). The curve of the beam 264 may be defined by multiple linear segments of the beam 264 that connect to each other at various angles. The beam 264 bows or curves into the channel 194 such that a medial segment along the length of the beam 264 is disposed farther from the side wall 182 than segments of the beam 264 located more proximate to the ends 260, 262. The beam 264 is U-shaped or C-shaped in the illustrated embodiment, but the beam 264 may be V-shaped of the like in other embodiments. In one or more alternative embodiments, the beam 264 may have only one end anchored to the ground shield 146 such that the beam 264 may have one free end that does not engage the wall of the ground shield 146 (as shown in FIGS. 8 and 9) or one end that engages and moves along the wall of the ground shield 146 (as shown in FIG. 10).

The spring tab 196 is shown in an undeflected position. As described herein, the spring tab 196 is configured to be deflected outward in a direction away from the channel 194 during a mating operation. Therefore, when the spring tab 196 is deflected, the beam 264 does not extend as far into the channel 194.

In the illustrated embodiment, the ground shield 146 includes a window 266 extending through each of the side walls 182 between the inner and outer surfaces 190, 192. The window 266 may be formed by stamping and/or punching the ground shield 146 to remove material from the side wall 182. For example, the window 266 may be formed by removing material below and/or above the beam 264 and subsequently bending the beam 264 out of the plane of the side wall 182. The window 266 aligns with the spring tab 196 such that the beam 264 extends across the window 266 between the two ends 260, 262. In an embodiment, the spring tab 196 is configured to deflect at least partially through the window 266 when the spring tab 196 is deflected outward.

Figure 6:
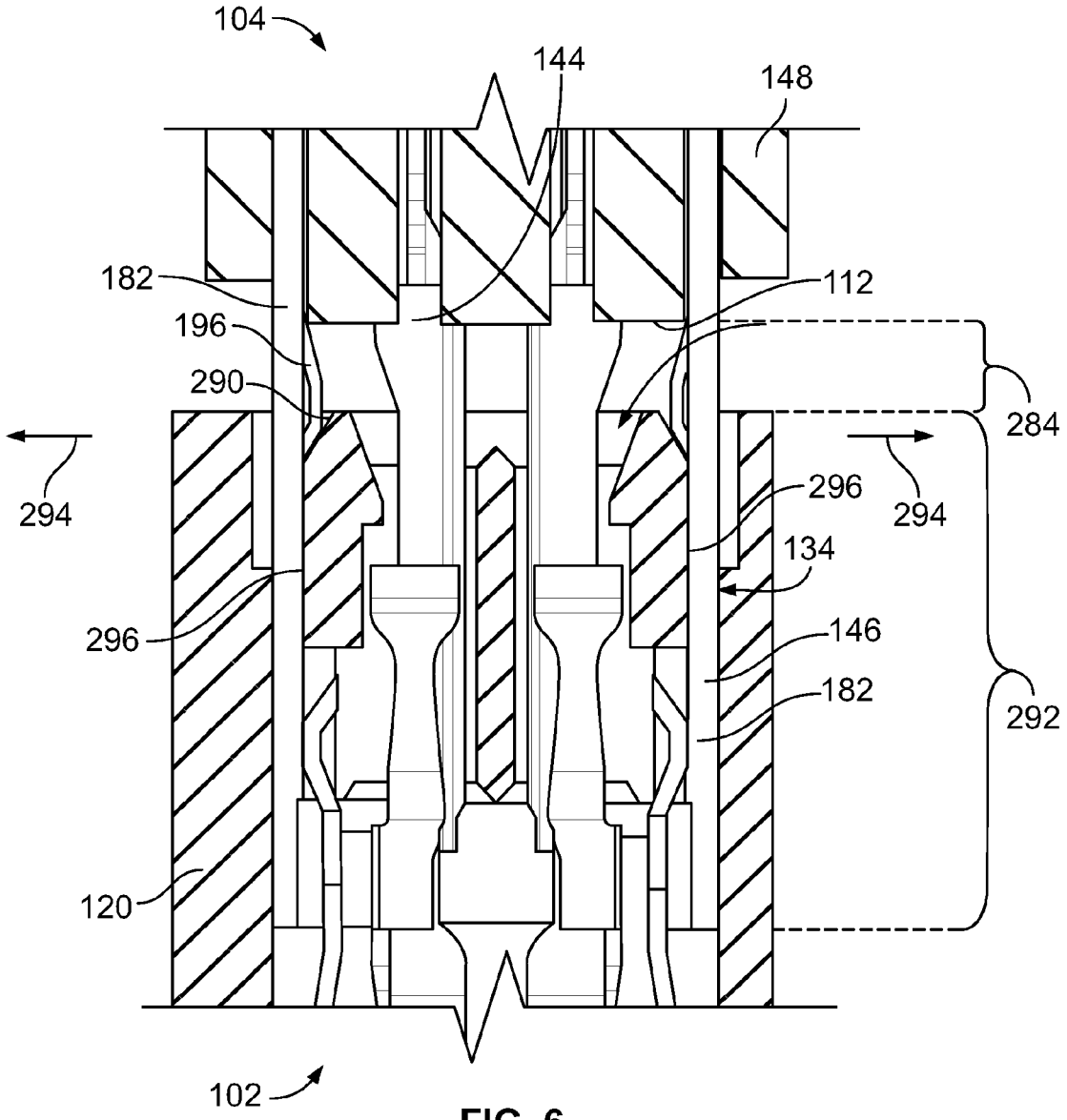
FIG. 6 is cross-sectional view of the portion of the header connector shown in FIG. 5 in a second partially mated position relative to the portion of the receptacle connector.
Figure 7:
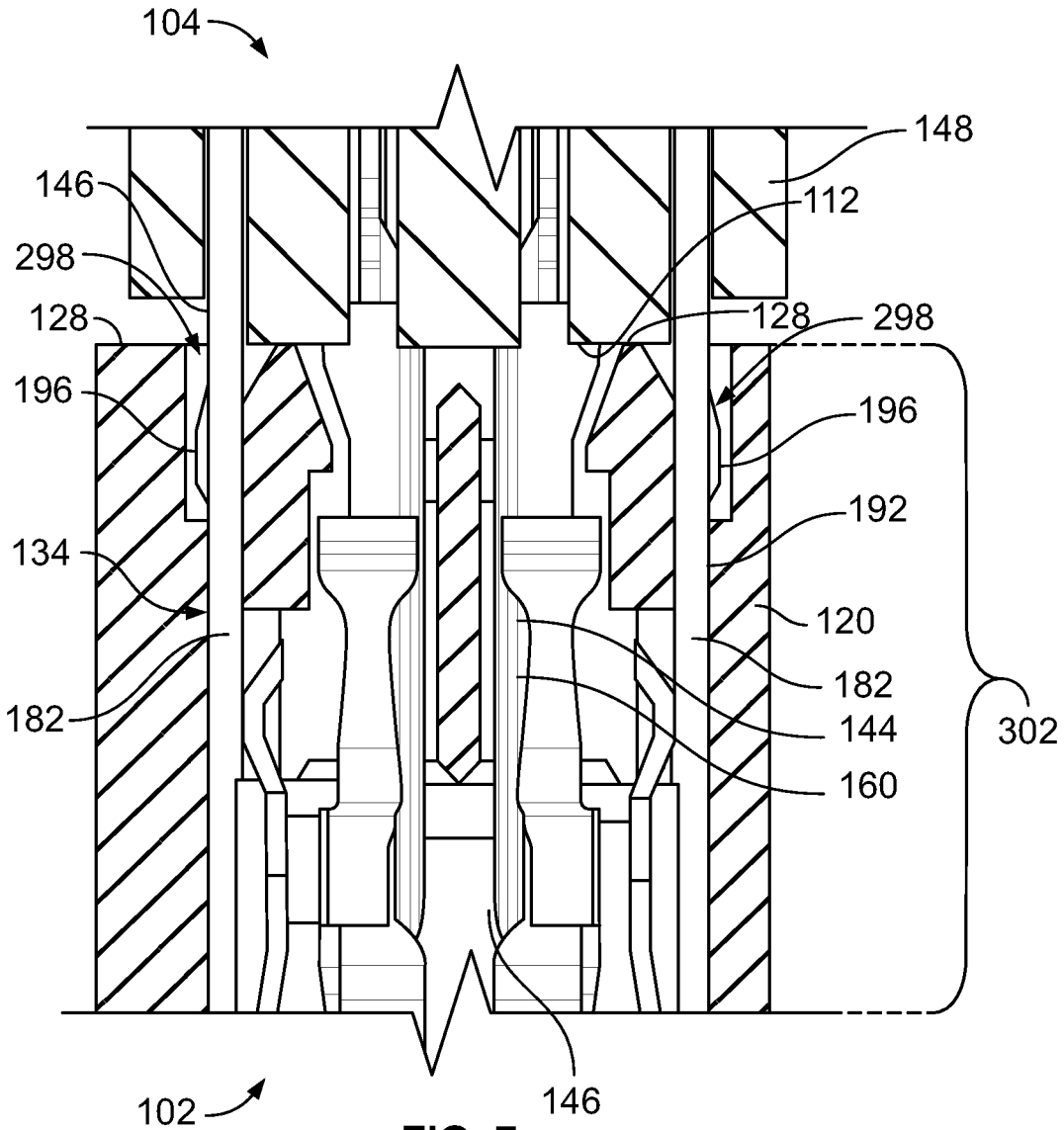
FIG. 7 is cross-sectional view of the portion of the header connector shown in FIG. 5 in a fully mated position relative to the portion of the receptacle connector.

FIGS. 5-7 are cross-sectional views of portions of the header connector 104 and the receptacle connector 102 at various relative mated positions according to an embodiment. FIG. 5 shows a portion of the header connector 104 in a first partially mated position relative to a corresponding portion of the receptacle connector 102. FIG. 6 shows the portion of the header connector 104 in a second partially mated position relative to the receptacle connector 102. FIG. 7 shows the portion of the header connector 104 in a fully mated position relative to the receptacle connector 102.

During a mating operation, the mating segments 160 of the signal contacts 144 are received in the signal openings 132 of the receptacle housing 120. The mating segments 160 engage and electrically connect to corresponding receptacle signal contacts 280 to provide a conductive signal transmission path across the connectors 102, 104. The receptacle signal contacts 280 in the illustrated embodiment are paddles, but may have other shapes and/or interfaces in other embodiments. The mating end 176 of the ground shield 146 extends into the ground slot 134 of the receptacle housing 120. The ground shield 146 engages and electrically connects to corresponding ground contacts 282 of the receptacle connector 102 to define a grounding path and/or signal return path across the connectors 102, 104.

When the connectors 102, 104 are partially mated, as shown in FIGS. 5 and 6, the header signal contacts 144 are electrically connected to the receptacle signal contacts 280 and the header ground shields 146 are electrically connected to the receptacle ground contacts 282. However, the header housing 138 is not fully mated with the receptacle housing 120. For example, the header housing 138 has not reached a hard stop position that prevents further movement of the header connector 104 in a mating direction towards the receptacle connector 102. As shown in FIG. 5, the front side 112 of the base 148 is spaced apart from the mating end 128 of the receptacle housing 120 by a gap 284 at the mating interface. The gap 284 has a first length defined between the front side 112 and the mating end 128. The header signal contacts 144 and the ground shield 146 extend across the gap 284 into the corresponding signal openings 132 and ground slot 134. The ground shield 146 extends a first mating depth 288 into the ground slot 134.

The spring tabs 196 of the ground shield 146 are positioned forward of the base 148 of the header housing 138 and are aligned with the gap 284. For example, the first end 260 of each of the spring tabs 196 is disposed proximate to the front side 112 of the base 148, and the second end 262 is disposed forward of the front side 112. In the illustrate embodiment, the first end 260 aligns with the front side 112 of the base 148, and the second end 262 is received within the ground slot 134 of the receptacle housing 120. Therefore, the spring tabs 196 span the length of the gap 284.

The spring tabs 196 are configured to be variably positionable based on the mating depth of the ground shield 146 within the ground slot 134 of the receptacle housing 120. For example, the spring tabs 196 are configured to be deflected by the receptacle housing 120 during the mating operation, and the extent that the receptacle housing 120 deflects the spring tabs 196 is based on the mating depth of the ground shield 146. In the first partially mated position shown in FIG. 5, the spring tabs 196 are in an undeflected position. The receptacle housing 120 does not deflect the spring tabs 196 in the first partially mated position. For example, the receptacle housing 120 may include a ramp 290 along the ground slot 134 at the mating end 128 of the housing 120 that provides a tapered lead-in for the ground shield 146. In the first partially mated position, the ramp 290 may contact the spring tabs 196 without deflecting the spring tabs 196. In the undeflected position, the spring tabs 196 extend from the respective side walls 182 of the shield 146 towards the signal contacts 144 between the side walls 182. The spring tabs 196 do not engage the signal contacts 144, thus avoiding an electrical short. As described above, the increased proximity of conductive material to the signal contacts 144 along the portion of the signal contacts 144 in the gap 284 may enhance signal transmission by reducing an impedance spike due to the air in the gap 284.

In the second partially mated position shown in FIG. 6, the header and receptacle connectors 102, 104 are not fully mated but are mated to a greater extent than in the first partially mated position shown in FIG. 5. For example, the ground shield 146 in the second partially mated position extends a second mating depth 292 into the ground slot 134 of the receptacle housing 120 that is greater than the first mating depth 288 shown in FIG. 5. In addition, the gap 284 between the base 148 and the receptacle housing 120 in the second partially mated position has a length that is less than the length of the gap 284 in the first partially mated position. Compared to the first partially mated position, a greater proportion of the spring tabs 196 is received in the ground slot 134 of the receptacle housing 120 in the second partially mated position. For example, a majority or at least a significant portion of the length of each spring tab 196 is disposed within the ground slot 134. Another portion of each spring tab 196 extends across the gap 284 to the first end 260 (shown in FIG. 5) of the spring tab 196 at or proximate to the front side 112 of the base 148. Therefore, the spring tabs 196 still span the length of the gap 284.

The spring tabs 196 in the second partially mated position are in a deflected position. As the ground shield 146 is loaded into the ground slot 134 of the receptacle housing 120 to the second partially mated position, the ramp 290 of the housing 120 engages and forces the spring tabs 196 to deflect outward in corresponding outward directions 294 to the deflected position. The spring tabs 196 deflect away from the signal contacts 144 that are located between the side walls 182. For example, the spring tabs 196 in the deflected position are farther from the signal contacts 144 than the proximity of the spring tabs 196 to the signal contacts 144 in the undeflected position shown in FIG. 5. The spring tabs 196 deflect towards the respective side walls 182 from which the spring tabs 196 extend, and optionally extend at least partially through the windows 266 (shown in FIG. 4). The spring tabs 196 may be retained in the deflected position due to a normal force exerted on the spring tabs 196 by the ramp 290 and/or an interior wall 296 of the receptacle housing 120 within the ground slot 134.

In the fully mated position shown in FIG. 7, the header connector 104 and the receptacle connector 102 have reached the hard stop position that prevents additional movement in the mating direction. In the illustrated embodiment, the front side 112 of the base 148 engages and abuts against the mating end 128 of the receptacle housing 120 to define a hard stop interface. Thus, there is no gap between the base 148 and the receptacle housing 120. The receptacle housing 120 fully surrounds the mating segments 160 of the signal contacts 144 that project forward of the base 148. In the fully mated position, the ground shield 146 is received a third mating depth 302 into the ground slot 134 of the receptacle housing 120. The third mating depth 302 is greater than the first and second mating depths 288, 292 shown in FIGS. 5 and 6, respectively.

In the fully mated position, the spring tabs 196 are deflected outward by the receptacle housing 120 away from the signal contacts 144 to a deflected position. In an embodiment, an amount of deflection of the spring tabs 196 increases with an increasing mating depth of the ground shield 146 in the ground slot 134 of the receptacle housing 120. As shown in FIGS. 5-7, as the mating depth (for example, mating depths 288, 292, 302) of the ground shield 146 increases, the amount of deflection of the spring tabs 196 away from the signal contacts 144 also increases. The spring tabs 196 are deflected outward to the greatest extent when the connectors 102, 104 are fully mated. As shown in FIG. 7, a portion of the spring tabs 196 may extend through the windows 266 (shown in FIG. 4) and protrude beyond the outer surfaces 192 of the side walls 182. The receptacle housing 120 may include pockets 298 along the ground slot 134 extending from the mating end 128. The pockets 298 are configured to accommodate the portions of the deflected spring tabs 196 that protrude beyond the outer surfaces 192 of the side walls 182.

In an embodiment, when the spring tabs 196 are deflected, the spring tabs 196 exert a biasing force on the receptacle housing 120 in a direction towards the signal contacts 144. As the connectors 102, 104 are pulled apart from each other, such as during an unmating process, the spring tabs 196 resile towards the undeflected position shown in FIG. 5 as the length of the gap 284 (shown in FIGS. 5 and 6) increases.

FIG. 8 is a cross-sectional view of a portion of the header connector 104 in a partially mated position relative to the receptacle connector 102 according to an alternative embodiment. FIG. 9 is a cross-sectional view of the portion of the header connector 104 shown in FIG. 8 in a fully mated position relative to the receptacle connector 102. Unlike FIGS. 5-7, the cross-section in FIGS. 8 and 9 extends through the ground shield 146, and the windows 266 of the ground shield 146 are visible. The spring tabs 196 in FIGS. 8 and 9 differ from the spring tabs 196 shown in FIGS. 4-7 in that the beams 264 in FIGS. 8 and 9 are cantilevered from the ground shield 146. For example, the first ends 260 of the beams 264 proximate to the front side 112 of the base 148 are secured in place (for example, anchored) to the corresponding side walls 182 and define fixed ends. The second ends 262 define free ends that are spaced apart from and do not engage the side walls 182. In an alternative embodiment, the beams 264 may be reversed such that the first ends 260 are the free ends and the second ends 262 are the fixed ends. The fixed ends 260 may be integrally connected to the side walls 182, such as by stamping and forming the beams 264 out of the side walls 182. The beams 264 in an undeflected position shown in FIG. 8 extend towards the signal contacts 144. The free ends 262 are located more proximate to the signal contacts 144 than the fixed ends 260. In the illustrated embodiment, the free ends 262 curve at least partially outward to provide a smooth contact interface that prevents stubbing on the mating end 128 of the receptacle housing 120.

As the ground shield 146 is loaded farther into the ground slot 134 from the partially mated position shown in FIG. 8 to the fully mated position shown in FIG. 9, the receptacle housing 120 (for example, the ramp 290) engages the free ends 262 of the beams 264 and gradually deflects the beams 264 outward away from the signal contacts 144. As shown in FIG. 9, when the connectors 102, 104 are fully mated, the interior wall 296 of the receptacle housing 120 within the ground slot 134 forces the beams 264 at least partially through the windows 266. The cantilevered beams 264 are configured to pivot along the fixed ends 260 and/or bend along the lengths of the beams 264.

FIG. 10 illustrates a portion of the ground shield 146 according to another alternative embodiment. The ground shield 146 in FIG. 10 has different deflectable spring tabs 196 than the embodiments of the ground shield 146 shown in FIGS. 4-9. For example, the second end 262 of the beam 264 of each spring tab 196 that is most proximate to the mating end 176 of the ground shield 146 is secured or anchored in a fixed location relative to a corresponding side wall 182 of the ground shield 146. The first end 260 that is at least proximate to the front side 112 (shown in FIG. 3) of the base 148 (FIG. 3) engages the corresponding side wall 182 but is not secured in a fixed location relative to the side wall 182. Therefore, as the receptacle housing 120 (shown in FIG. 1) deflects the beam 264 outward toward the corresponding side wall 182 during the mating operation, the first end 260 is configured to slide in a rearward direction 340 along the inner surface 190 of the side wall 182 as the beam 264 straightens out from the curved orientation of the undeflected position shown in FIG. 10. As the connectors 102, 104 (shown in FIG. 1) are unmated, the beam 264 resiles towards the undeflected position and the movable first end 260 slides in a forward direction 342 as the beam 264 relaxes. Alternatively, the beams 264 may be reversed such that the first end 260 is secured to the side wall 182 in a fixed location and the second end 262 is configured to slide along the side wall 182.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing including a base having a front side and an opposite rear side, the base defining signal openings and ground slots;

a signal contact held in one of the signal openings of the base, the signal contact having a mating segment extending forward of the front side of the base; and a ground shield held in one of the ground slots of the base and extending forward of the front side of the base, the ground shield surrounding the signal contact on at least one side along a length of the signal contact, the ground shield including an inner surface that faces the signal contact and an opposite outer surface, the ground shield including a deflectable spring tab extending from the inner surface towards the signal contact without engaging the signal contact, the spring tab having a first end and a second end, the first end disposed at or rearward of the front side of the base and the second end disposed forward of the front side of the base, the spring tab configured to be deflected outward by a mating housing of a mating connector in a direction away from the signal contact during a mating operation.

2. The electrical connector of claim 1, wherein the first end of the spring tab is a fixed end that is secured to a wall of the ground shield and the second end of the spring tab is a free end that does not engage the wall of the ground shield.

3. The electrical connector of claim 1, wherein the spring tab is a beam that extends between the first end and the second end, the first and second ends both secured to a wall of the ground shield, wherein the beam extends toward the signal contact when the spring tab is in an undeflected position.

4. The electrical connector of claim 1, wherein the first end of the spring tab is secured to a wall of the ground shield, the second end of the spring tab configured to engage the wall of the ground shield and slide along the wall responsive to the mating housing of the mating connector deflecting the spring tab outward.

5. The electrical connector of claim 1, wherein the ground shield defines a window extending through a wall of the ground shield between the inner and outer surfaces, the spring tab configured to deflect at least partially through the window responsive to the mating housing of the mating connector deflecting the spring tab outward.

6. The electrical connector of claim 1, wherein the ground shield has at least one of a C-shaped cross-section, an L-shaped cross-section, or a rectangular cross-section.

7. The electrical connector of claim 1, wherein the ground shield includes a center wall and two side walls extending from opposite edges of the center wall, the center wall and the side walls surrounding the signal contact on three sides, wherein the spring tab is a first spring tab that extends from one of the two side walls and the electrical connector further includes a second spring tab extending from the other of the two side walls.

8. The electrical connector of claim 1, wherein, during the mating operation, the spring tab is deflected outward by the mating housing as the ground shield is received within a ground slot of the mating housing, the spring tab within the ground slot of the mating housing being spaced apart from and not directly engaging a mating ground contact of the mating connector that is within the ground slot of the mating housing.

9. An electrical connector comprising:

a housing including a base having a front side and an opposite rear side, the base defining signal openings and ground slots;

a signal contact held in one of the signal openings of the base, the signal contact having a mating segment extending forward of the front side of the base, the mating segment of the signal contact configured to be received in a signal opening of a mating housing of a mating connector during a mating operation; and a ground shield held in one of the ground slots of the base and extending forward of the front side of the base, the ground shield surrounding the signal contact on at least one side along a length of the signal contact, the ground shield including an inner surface that faces the signal contact and an opposite outer surface, the ground shield including a deflectable spring tab extending from the inner surface, the spring tab in an undeflected position extending towards the signal contact without engaging the signal contact, the spring tab having a first end and a second end, the first end disposed at or rearward of the front side of the base and the second end disposed forward of the front side of the base, the ground shield configured to be received in a ground slot of the mating housing during the mating operation, wherein, when the electrical connector is partially mated relative to the mating connector, such that the signal contact engages and electrically connects to the corresponding mating signal contact of the mating connector but the front side of the base is spaced apart from the mating housing of the connector by a gap, the spring tab spans the gap between the base and the mating housing, and wherein the spring tab is deflected outward by the mating housing of the mating connector in a direction away from the signal contact based on a mating depth that the ground shield extends into the ground slot of the mating housing during the mating operation.

10. The electrical connector of claim 9, wherein, when the electrical connector is in a first partially mated position relative to the mating connector, the spring tab is in the undeflected position and, when the electrical connector is in a second partially mated position relative to the mating connector with a greater mating depth of the ground shield in the ground slot of the mating housing than the first partially mated position, the spring tab is deflected outward by the mating housing of the mating connector.

11. The electrical connector of claim 10, wherein, when the electrical connector is in the second partially mated position relative to the mating connector, a first portion of the spring tab is disposed within the ground slot of the mating housing and a second portion of the spring tab is disposed in the gap between the front side of the base and the mating housing.

12. The electrical connector of claim 9, wherein, when the electrical connector is fully mated to the mating connector, the spring tab is deflected outward by the mating housing of the mating connector in a direction away from the signal contact and the front side of the base engages the mating housing of the mating connector.

13. The electrical connector of claim 9, wherein the first end of the spring tab is a fixed end that is secured to a wall of the ground shield and the second end of the spring tab is a free end that does not engage the wall of the ground shield.

14. The electrical connector of claim 9, wherein the spring tab is a beam that extends between the first end and the second end, the first and second ends both secured to a wall of the ground shield, wherein the beam extends toward the signal contact when the spring tab is in the undeflected position.

15. The electrical connector of claim 9, wherein the first end of the spring tab is secured to a wall of the ground shield, the second end of the spring tab configured to engage the wall of the ground shield and slide along the wall responsive to the mating housing of the mating connector deflecting the spring tab outward.

16. The electrical connector of claim 9, wherein the ground shield includes a center wall and two side walls extending from opposite edges of the center wall, the center wall and the side walls surrounding the signal contact on three sides, wherein the spring tab is a first spring tab that extends from one of the two side walls and the electrical connector further includes a second spring tab extending from the other of the two side walls.

17. The electrical connector of claim 9, wherein, during the mating operation, the spring tab is deflected outward by the mating housing as the ground shield is received within a ground slot of the mating housing, the spring tab within the ground slot of the mating housing being spaced apart from and not directly engaging a mating ground contact of the mating connector that is within the ground slot of the mating housing.

18. A connector assembly comprising:

a header connector including a base, a header signal contact held in the base, and a header ground shield held in the base, the base having a front side and an opposite rear side, the header signal contact having a mating segment extending forward of the front side of the base, the header ground shield extending forward of the front side of the base and surrounding the header signal contact on at least one side along a length of the header signal contact, the header ground shield including a deflectable spring tab that, when in an undeflected position, extends toward the header signal contact without engaging the header signal contact, at least a majority of the spring tab disposed forward of the front side of the base; and a receptacle connector including a receptacle housing comprising a dielectric material, a receptacle signal contact, and a receptacle ground contact, the receptacle housing defining a signal opening and a ground slot at a mating end of the receptacle housing, the receptacle signal contact disposed within the signal opening and the receptacle ground contact disposed within the ground slot;

wherein, during a mating operation, the mating segment of the header signal contact is received within the signal opening to engage the receptacle signal contact and the header ground shield is received within the ground slot to engage the receptacle ground contact, wherein, during the mating operation, the receptacle housing at the mating end engages the spring tab of the header ground shield and deflects the spring tab outward in a direction away from the header signal contact as the header ground shield is received within the ground slot.

19. The connector assembly of claim 18, wherein the receptacle housing includes a ramp that extends from the mating end into the ground slot, the ramp configured to engage the spring tab of the header ground shield as the header ground shield is received within the ground slot to gradually deflect the spring tab outward to a deflected position.

20. The connector assembly of claim 18, wherein the spring tab of the header ground shield is spaced apart from the receptacle ground contact within the ground slot when the header connector is mated to the receptacle connector such that the spring tab does not engage the receptacle ground contact.

* * * * *